US005504471A

United States Patent [19]

Lund

[11] Patent Number: 5,504,471

[45] Date of Patent: Apr. 2, 1996

[54] PASSIVELY-MULTIPLEXED RESISTOR ARRAY

[75] Inventor: Mark D. Lund, Vancouver, Wash.

[73] Assignee: Hewlett-Packard Company, Palo Alto, Calif.

[21] Appl. No.: 123,482

[22] Filed: Sep. 16, 1993

[51] Int. Cl.[6] ..... H01C 1/01

[52] U.S. Cl. ..... 338/320

[58] Field of Search ..... 338/320, 319, 338/260; 400/124.01–124.05, 120.01, 120.12; 347/209, 210

[56] References Cited

U.S. PATENT DOCUMENTS

| | | | |
|---|---|---|---|
| 3,965,330 | 6/1976 | Williams | 347/210 |
| 4,360,818 | 11/1982 | Moriguchi et al. | 346/76 |
| 4,633,228 | 12/1986 | Larson | 340/365 E |
| 4,791,440 | 12/1988 | Eldridge et al. | 346/140 R |
| 5,134,425 | 7/1992 | Yeung | 347/209 |
| 5,144,336 | 9/1992 | Yeung | 347/209 |
| 5,163,760 | 11/1992 | Nardozzi | 400/130 |
| 5,235,346 | 8/1993 | Yeung | 347/209 |

FOREIGN PATENT DOCUMENTS

| | | |
|---|---|---|
| 0359669 | 9/1989 | European Pat. Off. . |
| 3633563 | 10/1986 | Germany . |
| 2031805 | 10/1978 | United Kingdom . |

*Primary Examiner*—Marvin M. Lateef

[57] ABSTRACT

A passively-multiplexed resistor array has rows and columns of conductors. Resistors span the intersections of the conductors, and one or more selected resistors may be energized by energizing the corresponding row(s) and column(s). However, other, unselected, resistors may also be partially energized. By adding additional rows or columns of "minimizer" resistors, the maximum power in unselected resistors may be reduced. The minimizer resistors are electrically connected in the passively-multiplexed resistor array but do not perform the function of the other resistors in the array.

14 Claims, 5 Drawing Sheets

PASSIVELY-MULTIPLEXED RESISTOR ARRAY

BACKGROUND OF THE INVENTION

FIELD OF THE INVENTION

The present invention relates to the field of passively-multiplexed resistor arrays. More specifically, the present invention pertains to decreasing the peak power dissipated by unselected resistors in a passively-multiplexed resistor array.

RELATED ART

Large resistors arrays are used in many applications. Two examples are thermal printheads used to print on thermal paper or used in thermal transfer printing and thermal ink-jet printheads. In these applications, electric currents are driven through selected resistors in the resistor array to "mark" the print medium at a specific location.

Because these resistor arrays can comprise large numbers of resistors, directly driving each resistor is typically impractical. Thus, some form of multiplexing may be used, thereby decreasing the number of leads required to control the resistors.

One type of multiplexing is known as "passive multiplexing," and is shown in FIG. 1. In the exemplary passively-multiplexed resistor array shown, a plurality of resistors $R_{11}$-$R_{64}$ are connected in an array having six rows 12*a*-12*f* and four columns 10*a*-10*d*.

The columns 10*a*-10*d* may be selectively connected to a voltage source 16 via column switches 18*a*-18*d*. Each column 10*a*-10*d* can be "activated" in turn by closing its respective column switch. In passive multiplexing, only one column switch may be closed at one time; the other column switches must be open. The rows 12*a*-12*f* may be selectively connected to ground via switches 20*a*-20*f*. Each row 12*a*-12*f* can be selected by closing its respective switch. Multiple rows may be selected simultaneously.

Each resistor $R_{11}$-$R_{64}$ bridges a respective intersection of the rows 12*a*-12*f* and columns 10*a*-10*d*. By activating a column and selecting a row, the resistor which bridges the activated column and selected row thereby has a voltage imposed across it and is thus directly driven. In FIG. 1, the first column 10*a* is shown activated and the first and third rows 12*a* and 12*c* are shown selected. Thus, resistors R11 and R31 are shown directly driven.

In the schematic diagram of FIG. 1, the resistors $R_{11}$-$R_{64}$ are shown in a rectangular arrangement. This graphical arrangement is selected only for the convenience of this description. The resistors may be physically arrayed in any arbitrary arrangement provided that the electrical connections remain as shown. For example, the resistors could be arranged in a line for a thermal printhead or a pair of lines for a thermal ink-jet printhead.

In a passively-multiplexed resistor array, current can flow through every resistor $R_{11}$-$R_{64}$ in the array. For example, referring to FIG. 1, with the switches in the states shown, "parasitic" current flows along the first column 10*a*, through resistor $R_{21}$, along the second row 12*b*, through resistor $R_{22}$, along the second column 10*b*, through resistor $R_{12}$, and along the first row to the ground via the first row switch 20*a*.

One problem with the parasitic current is that an unselected resistor may receive enough parasitic energy to "fire." That is, the resistor may generate enough heat to mark the media in thermal printheads or to eject ink in ink-jet printheads. What is needed is a passively-multiplexed resistor array which decreases the amount of energy dissipated by an unselected resistor.

SUMMARY OF THE INVENTION

It is a principal object of the present invention to provide a passively-multiplexed resistor array which decreases the parasitic power dissipated through unselected resistors.

The present invention is directed to a passively-multiplexed resistor array having at least one row of "minimizer" resistors. These minimizer resistors may be selected to decrease the parasitic power dissipated through unselected resistors.

These and other features, aspects, and advantages of the present invention will become better understood with reference to the following description and appended claims.

DETAILED DESCRIPTION OF THE INVENTION

Figure 1:
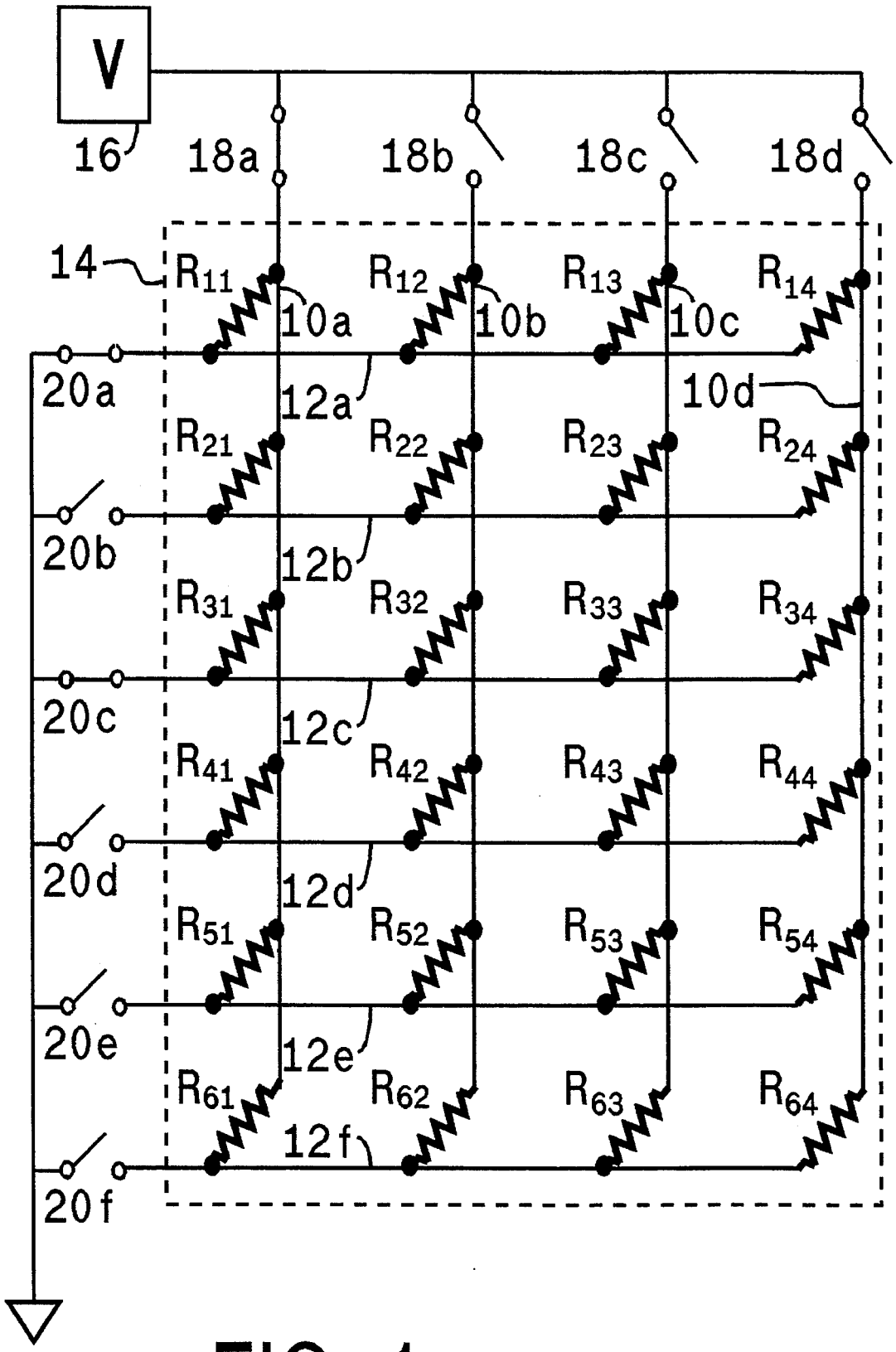
FIG. 1 (PRIOR ART)
FIG. 1 shows a schematic diagram of a prior art passively-multiplexed resistor array.
Figure 2:
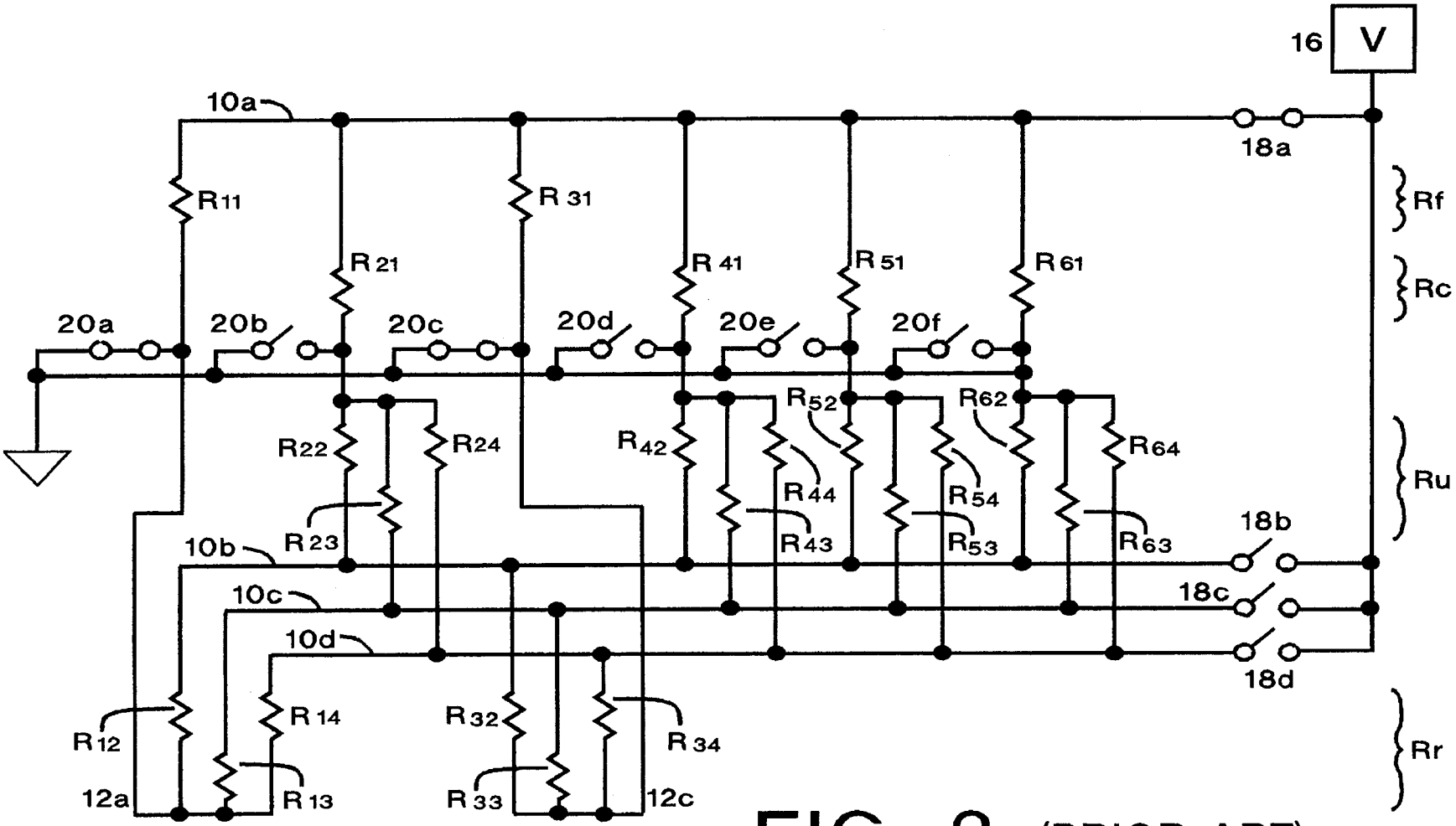
FIG. 2 (PRIOR ART)
FIG. 2 shows the resistor array of FIG. 1 rearranged to show more clearly the parasitic currents.

FIG. 2 shows the circuit of FIG. 1 rearranged to show the parasitic current paths. The first column switch 18*a* is closed, thereby activating the first column 10*a*. The other column switches 18*b*-18*d* are open. The first and third row switches 20*a* and 20*c* are closed, thereby selecting the first and third rows 12*a* and 12*c* and directly driving resistors $R_{11}$ and $R_{31}$. The directly driven, or "fired" resistors are generally designated by reference Rf. The other row switches 20*b* and 20*d*-20*f* are open.

In addition to the directly-driven resistors $R_{11}$ and $R_{31}$, current also flows through the other, unselected resistors $R_{21}$ and $R_{41}$-$R_{61}$ connected to the first column 10*a*. These resistors are designated generally in FIG. 2 by reference $R_c$. From there, the current flows through the resistors which are neither in an activated column nor in a selected row, generally designated by reference $R_u$. Finally, the current flows through the resistors in the selected rows, generally designated by reference $R_r$, back to ground.

In many applications, all of the resistors in the array have the same resistance. For thermal ink-jet printing, designing the printhead such that the resistances (as well as other parameters) are equal ensures that the printhead provides uniform performance for the numerous nozzles. Thus, for the rest of this discussion, the resistors in the resistor array will be assumed to be of equal resistance. In such a case, it is much simpler to obtain solutions for the parasitic currents through the resistors which are not directly driven.

To represent these solutions mathematically, the following symbols are defined:

Rows=the number of rows in the array

Columns=the number of columns in the array

N=the number of activated resistors in the selected column

R=the value of any resistor in the array

Because of symmetry, the second through fourth columns 10*b*-10*d* can be considered as though they were interconnected. Thus the total resistance $R_{c,t}$ of the resistors $R_c$ in the active column which are not selected is simply the parallel combination of the resistances and is given in the following equation:

$$R_{c,t}=\frac{R}{Rows-N} \tag{1}$$

Similarly, the total resistance $R_{u,t}$ of the unrelated resistors $R_u$ not in the active column nor in a selected row is given in the following equation:

$$R_{u,t}=\frac{R}{(Columns-1)(Rows-N)} \tag{2}$$

And finally, the total resistance $R_{r,t}$ of the resistors $R_r$ not in the active column but in a selected row is given in the following equation:

$$R_{r,t}=\frac{R}{(Columns-1)(N)} \tag{3}$$

The power through the directly-driven resistors $R_{11}$ and $R_{31}$ is:

$$P_f=I^2R=\frac{V^2}{R} \tag{4}$$

The total power through the resistors $R_c$ in the active column which are not selected is given by:

$$P_c=\frac{V^2}{(R_{c,t}+R_{u,t}+R_{r,t})^2}\cdot\frac{R_{c,t}}{(Rows-N)} \tag{5}$$

Thus, the power through a single, unselected resistor $R_c$ in the active column is:

$$P_c=\frac{V^2}{(R_{c,t}+R_{u,t}+R_{r,t})^2}\cdot\frac{R}{(Rows-N)^2} \tag{6}$$

Dividing by $V^2/R$ normalizes the resulting value to the power dissipated by a directly-driven resistor $R_f$, and results in the ratio:

$$\frac{P_c}{P_f}=\frac{1}{(R_{c,t}+R_{u,t}+R_{r,t})^2}\cdot\frac{R^2}{(Rows-N)^2} \tag{7}$$

Likewise, the equations for the powers through the resistors $P_u$ in rows and columns unrelated to selected resistors, and for resistors $R_r$ in the selected rows, respectively, are:

$$\frac{P_u}{P_f}=\frac{1}{(R_{c,t}+R_{u,t}+R_{r,t})^2}\cdot\frac{R^2}{[(Columns-1)(Rows-N)]^2} \tag{8}$$

$$\frac{P_r}{P_f}=\frac{1}{(R_{c,t}+R_{u,t}+R_{r,t})^2}\cdot\frac{R^2}{[(Columns-1)(N)]^2} \tag{9}$$

Using the equations given above, the relative powers dissipated through the parasitic currents can be calculated. Results of the calculations for the unselected resistors $R_c$ in the active column, the unrelated resistors $R_u$ which are not in the active column nor in a selected row, and the resistors $R_r$ in the selected rows, for various numbers N of directly-driven resistors, are shown in Table 1.

TABLE 1

| N | 1 | 2 | 3 | 4 | 5 | 6 |
|---|---|---|---|---|---|---|
| Pc/Pf | 11.1% | 25.0% | 36.0% | 44.4% | 51.0% | 0.0% |
| Pu/Pf | 1.2% | 2.8% | 4.0% | 4.9% | 5.7% | 0.0% |
| Pr/Pf | 30.9% | 11.1% | 4.0% | 1.2% | 0.2% | 0.0% |

As shown by Table 1, when five resistors are being directly driven (N=5), then the unselected resistor $R_c$ in the active column dissipates 51.0 percent of the energy dissipated by one directly-driven resistor. This value is large enough to likely cause a thermal printhead to print or a thermal ink-jet printhead to eject ink.

Equations 7–9 show that the maximum parasitic power dissipated through an unselected resistor is dependent on the size of the resistor array and the number of resistors being directly driven. This fact can be used to minimize the maximum parasitic power dissipated through an unselected resistor.

Figure 3:
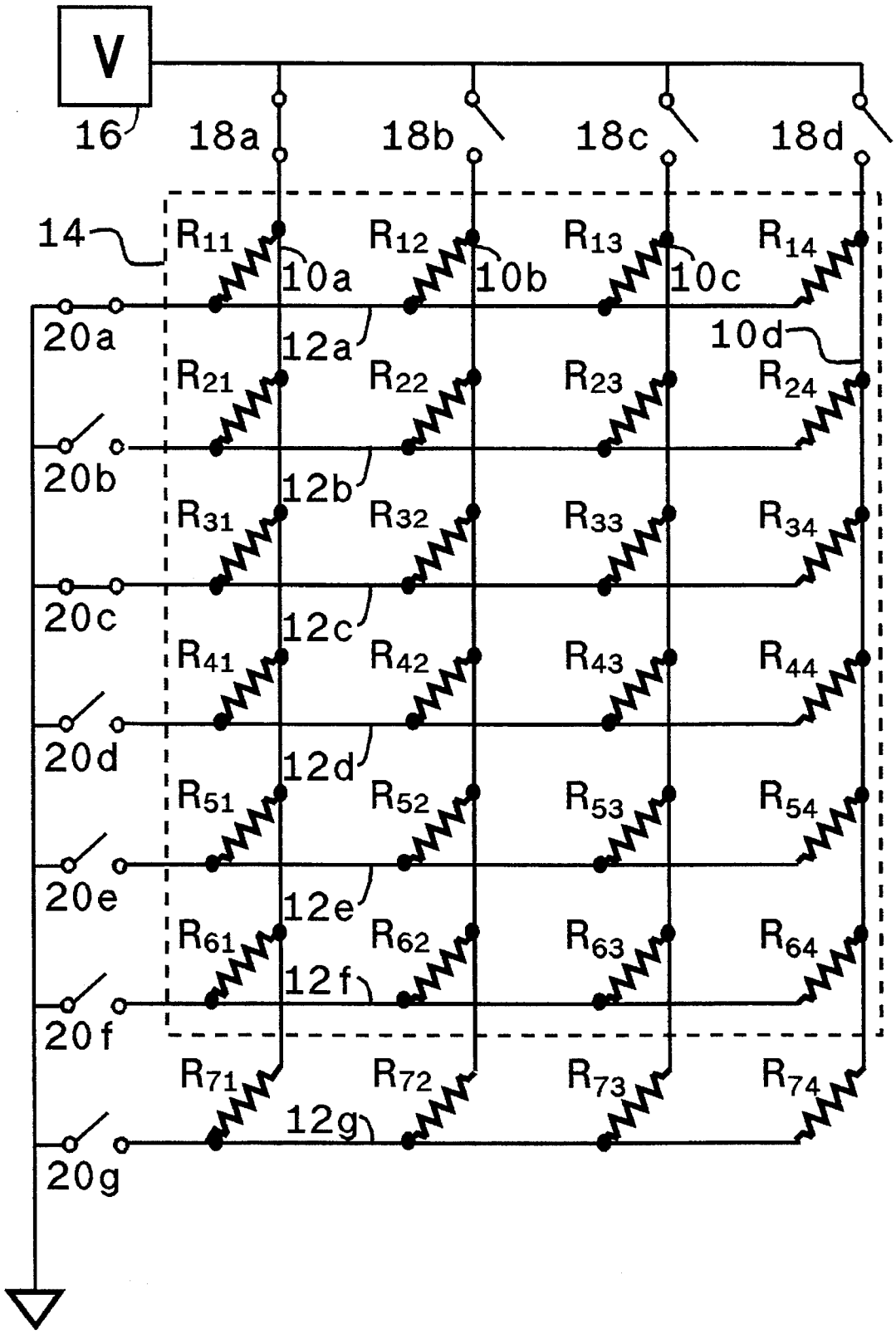
FIG. 3 shows a passively-multiplexed resistor array according to the present invention having a single row of minimizer resistors.

Referring now to FIG. 3, a passively-multiplexed resistor array according to the present invention is shown. As in the prior art, the resistor array has resistors $R_{11}$-$R_{64}$ electrically arranged into six rows 12*a*-12*f* and four columns 10*a*-10*d*. Likewise, row switches 20*a*-20*f* and column switches 18*a*-18*d* selectively connect the rows and columns to ground and a voltage source 16, respectively.

The resistor array further includes an extra row 12*g* of "minimizer" resistors $R_{71}$-$R_{74}$. These minimizer resistors, although electrically connected in the resistor array, do not perform the function of the other resistors in the array. In the preferred embodiment, the resistor array is included in a thermal printhead or thermal ink-jet printhead. The resistors $R_{11}$-$R_{64}$ enclosed by the dashed line 14 generate heat which is used to print. The minimizer resistors $R_{71}$-$R_{74}$, although they do generate heat, are physically arranged such that they do not cause printing, or if in a thermal ink-jet printhead, the minimizer resistors do not cause ink to eject from a nozzle. Rather, these minimizer resistors may be selectively fired to decrease the maximum energy dissipated in other, unselected resistors which otherwise perform a printing function.

There is no requirement that the minimizer resistors $R_{71}$-$R_{74}$ even be located on the printhead. As long as the electrical connections remain as shown in FIG. 3, the physical arrangement may be changed.

Using equations 7–9, the relative dissipated powers for resistors $R_c$, $R_u$, and $R_r$ are calculated for different numbers N of rows simultaneously selected and are listed in Table 2. Although only six rows of resistors are used for printing, the seventh, minimizer row is included in the table since it may be selectively fired.

TABLE 2

| N | 1 | 2 | 3 | 4 | 5 | 6 | 7 |
|---|---|---|---|---|---|---|---|
| $P_c/P_f$ | 9.0% | 21.3% | 31.6% | 39.9% | 46.5% | 51.8% | 0.0% |
| $P_u/P_f$ | 1.0% | 2.4% | 3.5% | 4.4% | 5.2% | 5.8% | 0.0% |
| $P_r/P_f$ | 36.0% | 14.8% | 6.3% | 2.5% | 0.8% | 0.2% | 0.0% |

To decrease the parasitic currents, the minimizer row 12*g* is selected any time one or six other resistors are driven in the active column. For example, if row switch 20*b* is closed, selecting the second row, and the other row switches 20*a* and 20*c*-20*f* are open, then minimizer row switch 20*g* will be closed to have two resistors will be selected (N=2). Likewise, if all six row switches 20*a*-20*f* are closed, then minimizer row switch 20*g* will be closed to have all resistors selected (N=7). One or six total resistors will never be selected simultaneously. Therefore, the worst-case parasitic power to an unselected resistor is 46.5 percent of a directly-driven resistor which occurs when N equals five.

Figure 4:
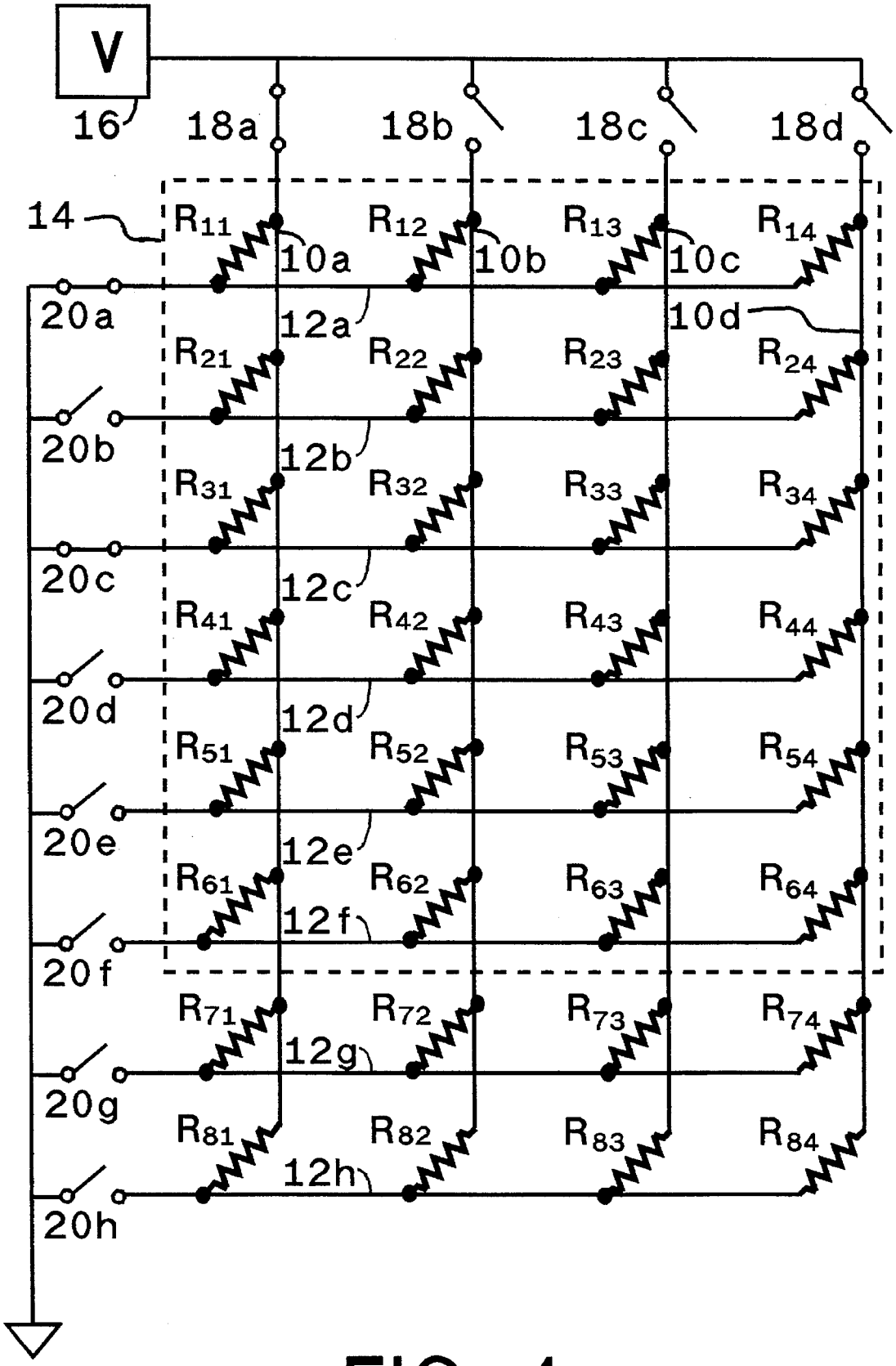
FIG. 4 shows the passively-multiplexed resistor array of FIG. 3, further comprising a second row of minimizer resistors.

Referring now to FIG. 4, another passively-multiplexed resistor array according to the present invention is shown. As in the prior art, the resistor array has resistors $R_{11}$-$R_{64}$ electrically arranged into six rows 12*a*-12*f* and four columns 10*a*-10*d*. Likewise, row switches 20*a*-20*f* and column switches 18*a*-18*d* selectively connect the rows and columns to ground and a voltage source 16, respectively.

The resistor array further includes two extra rows 12*g*-12*h* of minimizer resistors $R_{71}$-$R_{84}$. As in the case of a single row of minimizer resistors, these minimizer resistors do not perform a printing function.

Table 3 shows the power dissipated in unselected resistors as a percentage of the power dissipated in directly-driven resistors for different numbers N of simultaneously selected rows.

TABLE 3

| N | 1 | 2 | 3 | 4 | 5 | 6 | 7 | 8 |
|---|---|---|---|---|---|---|---|---|
| $P_e/P_f$ | 7.4% | 18.4% | 28.0% | 36.0% | 42.5% | 47.9% | 52.4% | 0.0% |
| $P_u/P_f$ | 0.8% | 2.0% | 3.1% | 4.0% | 4.7% | 5.3% | 5.8% | 0.0% |
| $P_r/P_f$ | 40.5% | 18.4% | 8.7% | 4.0% | 1.7% | 0.6% | 0.1% | 0.0% |

The minimizer resistors are selected such that one, two, six, or seven resistors are never fired simultaneously in one column. For example, if one row switch 20*f* is closed to select row 20*f*, and row switches 20-20*a* are open, then minimizer row switches 20*g* and 20*h* will be closed such that N equals three. In this manner, the worst case parasitic power to an unselected resistor is 42.5 percent.

The present invention has been described in conjunction with thermal printheads and thermal ink-jet printheads. It will be understood by one of ordinary skill in the field that the invention is applicable to any passively-multiplexed resistor array.

There is no requirement that the minimizer resistors be located on a printhead or off the printhead. Rather, the requirement is that the minimizer resistors be electrically connected as an additional row which may be selected.

The present invention has been described with activated columns where a plurality of rows may be simultaneously selected. The invention is applicable in cases where only one "functional" resistor can be driven at once, with the minimizer resistor being driven to decrease the power dissipated through the unselected resistors.

The invention is equally applicable in the "transposed" case where a single row is activated and a column or columns may be selected.

Figure 5:
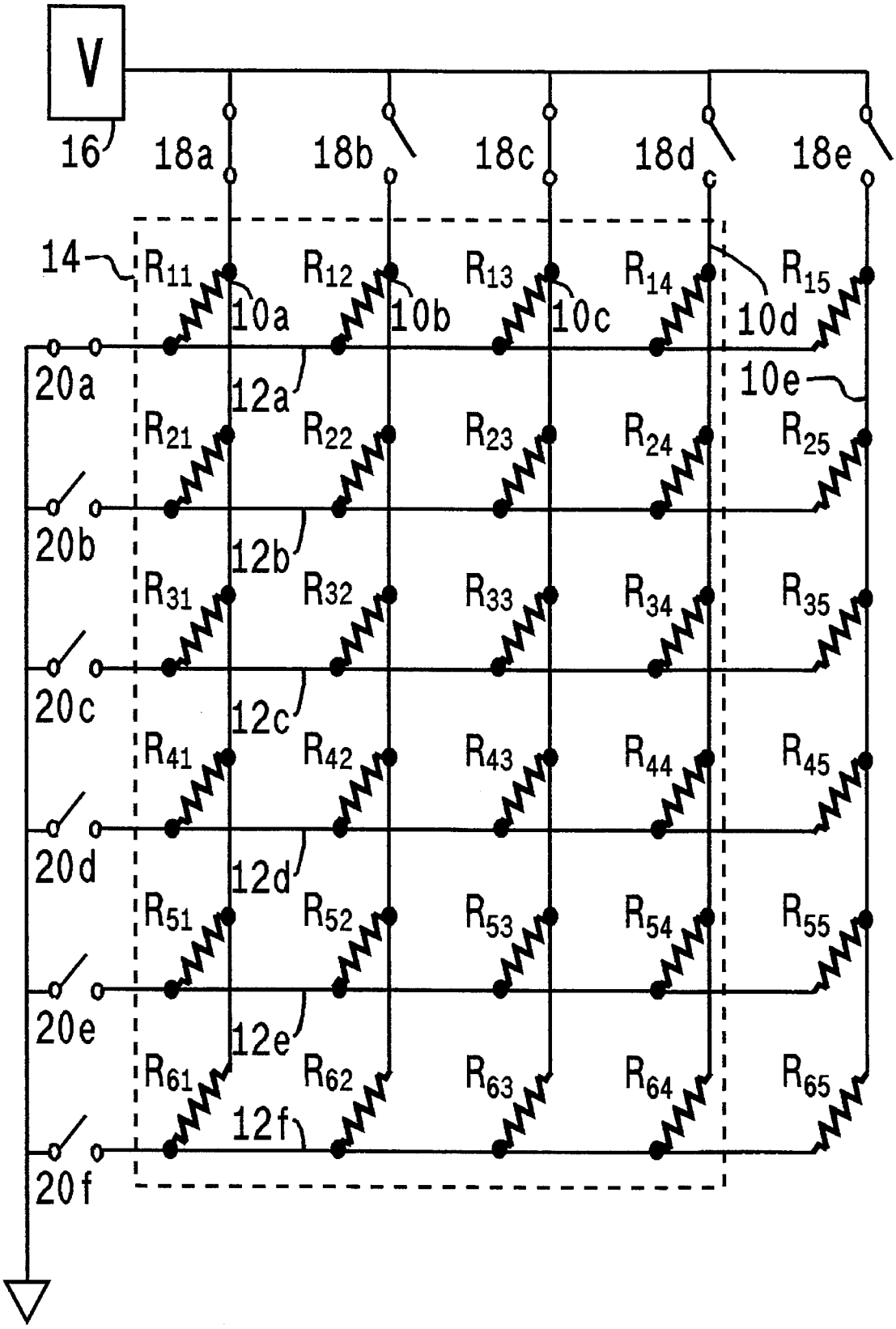
FIG. 5 shows the "transposed" case of FIG. 3, having a single column of minimizer resistors.

In such a case, an additional column or additional columns of minimizer resistors may be used in a manner parallel to that described above. FIG. 5 shows such an arrangement. An additional column 10*e*, with its associated switch 18*e*, is added to the structure of FIG. 1. Across the intersections of this column with the rows, a column of minimizer resistors $R_{15}$-$R_{65}$ is connected in a similiar manner and for the purposes already described. In FIG. 5, switch 20*a* is closed, selecting row 12*a*. Likewise, switches 18*a* and 18*c* are closed, activating columns 10*a* and 10*c*. The operation of the circuit may be understood by considering this arrangement as the transpose of FIG. 3, and applying the detailed explanation of that circuit.

Similiarly, the voltage source 16 may be interchanged with the ground connection in all the illustrated circuits with no effect on the principles of operation.

The resistor arrays shown in FIGS. 3, 4, and 5 are completely filled; that is, there is a resistor at each intersection of a row and column conductor. The present invention is applicable to resistor arrays which are sparsely populated, with no resistors at some intersections.

Therefore, the spirit and scope of the appended claims should not be limited to the description of the preferred versions contained herein.

What is claimed is:

1. A passively-multiplexed resistor array for coupling a power source to selected array resistors, comprising:

(a) a plurality of m row conductors;

(b) a plurality of n column conductors, where the row conductors and column conductors are electrically arranged to form a grid having m×n intersections;

(c) a plurality of array resistors, where each of the array resistors is connected between a respective intersection of the first m row conductors and the n column conductors for selectively receiving power;

(d) an (m+1)th row conductor arranged to intersect the n column conductors; and (e) a plurality of n minimizer resistors, where each of the minimizer resistors is connected between a respective intersection of the (m+1)th row conductor and the n column conductors;

wherein the (m+1)th row conductor is selectively energized by the power source to minimize the peak parasitic power absorbed by an unselected array resistor.

2. The passively-multiplexed resistor array of claim 1, where the plurality of first resistors includes m×n resistors.

3. The passively-multiplexed resistor array of claim 1, where the plurality of first resistors have substantially the same resistance.

4. The passively-multiplexed resistor array of claim 3, where the plurality of first resistors and the minimizer resistors have substantially the same resistance.

5. The passively-multiplexed resistor array of claim 1, further comprising (a) a (m+2)th row conductor arranged to intersect the n column conductors;

(b) a second plurality of n minimizer resistors, where each of the second plurality of n minimizer resistors is connected between a respective intersection of the (m+2)th row conductor and the n column conductors;

wherein both the (m+2)th row conductor and the (m+1)th row conductor are selectively energized by the power source to minimize the peak parasitic power absorbed by an unselected array resistor.

6. The passively-multiplexed resistor array of claim 5, where the plurality of first resistors have substantially the same resistance.

7. The passively-multiplexed resistor array of claim 6, where the plurality of first resistors and the minimizer resistors have substantially the same resistance.

8. In a rectangular passively-multiplexed resistor array having m rows and n columns of array resistors, where the array resistors are directly driven from a power source by activating a column and selecting a row, the improvement comprising an additional row of minimizer resistors connected to the passively-multiplexed resistor array, the additional row being selectively energized by the power source to minimize the peak parasitic power absorbed by an unselected array resistor.

9. The passively-multiplexed resistor array of claim 8, where the plurality of first resistors have substantially the same resistance.

10. The passively-multiplexed resistor array of claim 9, where the plurality of first resistors and the minimizer resistors have substantially the same resistance.

11. A passively-multiplexed resistor array for coupling a power source to selected array resistors, comprising:

(a) a plurality of m column conductors;

(b) a plurality of n row conductors, where the column conductors and row conductors are electrically arranged to form a grid having m×n intersections;

(c) a plurality of array resistors, where each of the array resistors is connected between a respective intersection of the first m column conductors and the n row conductors for selectively receiving power;

(d) an (m+1)th column conductor arranged to intersect the n row conductors; and (e) a plurality of n minimizer resistors, where each of the minimizer resistors is connected between a respective intersection of the (m+1)th column conductor and the n row conductors;

wherein the (m+1)th column conductor is selectively energized by the power source to minimize the peak parasitic power absorbed by an unselected array resistor.

12. In a passively-multiplexed array having m rows and n columns of conductors, array resistors connected between row and column intersections, and an electrical source for supplying power to selected array resistors by energizing corresponding rows and columns, a method for decreasing the peak parasitic power dissipated by unselected array resistors, comprising the steps of:

(a) providing a (m+1)th conductor row with minimizer resistors connected between the (m+1)th conductor row and the conductor columns; and (b) selectively energizing the (m+1)th conductor row with minimizer resistors to minimize the peak parasitic power dissipated by unselected array resistors.

13. The method of claim 12, where the first resistors have substantially the same resistance.

14. The method of claim 13, where the first resistors and the minimizer resistors have substantially the same resistance.

* * * * *